US007140724B2

(12) United States Patent
Otis et al.

(10) Patent No.: US 7,140,724 B2
(45) Date of Patent: Nov. 28, 2006

(54) IMAGING APPARATUS AND METHODS FOR HOMOGENIZING INK

(75) Inventors: David R. Otis, Corvallis, OR (US); Carrie Roberts, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 261 days.

(21) Appl. No.: 10/845,755

(22) Filed: May 13, 2004

(65) Prior Publication Data

US 2005/0253907 A1 Nov. 17, 2005

(51) Int. Cl.
*B41J 2/18* (2006.01)
*B41J 2/175* (2006.01)
*B41J 29/393* (2006.01)

(52) U.S. Cl. ..... 347/89; 347/19; 347/85

(58) Field of Classification Search ..... 347/5, 347/7, 19, 84, 85, 89
See application file for complete search history.

(56) References Cited

U.S. PATENT DOCUMENTS

| | | | | |
|---|---|---|---|---|
| 4,318,114 | A | 3/1982 | Huliba | |
| 4,374,386 | A | 2/1983 | Bildstein | |
| 4,380,770 | A | 4/1983 | Maruyama | |
| 4,734,711 | A | 3/1988 | Piatt et al. | |
| 4,929,963 | A | 5/1990 | Balazar | |
| 5,412,411 | A | 5/1995 | Anderson | |
| 5,936,650 | A | 8/1999 | Ouchida et al. | |
| 6,203,146 | B1 | 3/2001 | Pawlowksi | |
| 6,428,156 | B1 | 8/2002 | Waller et al. | |
| 6,945,640 | B1 * | 9/2005 | Cheok | 347/85 |
| 2002/0041315 | A1 | 4/2002 | Kubota | |

FOREIGN PATENT DOCUMENTS

| | | |
|---|---|---|
| EP | 0 674 998 | 10/1995 |
| EP | 1 359 027 | 11/2003 |
| JP | 06166184 | 6/1994 |
| JP | 10127656 | * 5/1998 |

* cited by examiner

*Primary Examiner*—Anh T. N. Vo

(57) ABSTRACT

Imaging apparatus and methods of homogenizing ink are described. In one implementation an imaging apparatus includes an ink supply to provide ink to be used in printing, and a printhead to apply the ink during printing. A conduit system couples the ink supply and the printhead in fluid flowing relation. A pump is operably coupled to the conduit system. In operation, the pump causes the ink to circulate between the ink supply and the printhead. A timing device measures an idle-time since the pump was last in operation. A controller receives the idle-time measurement from the timing device, and actuates the pump when a selected idle-time is reached. In another implementation, a method for homogenizing ink includes providing a pump, then automatically actuating the pump to homogenize ink within an ink delivery system each time the ink delivery system has been resting for a selected idle-time.

30 Claims, 4 Drawing Sheets

IMAGING APPARATUS AND METHODS FOR HOMOGENIZING INK

TECHNICAL FIELD

The present invention relates to imaging apparatus-and methods for homogenizing ink.

BACKGROUND

A wide variety of imaging apparatus and printing devices are used to produce printed materials. Such printing equipment typically includes an ink delivery system which functions to deliver liquid ink from an ink supply to one or more printheads. The printheads then apply the ink to an imaging media.

One popular type of printing apparatus are the ink-jet printers. Ink-jet printers are widely used as a means of producing high quality printing. A typical ink-jet printer includes an ink delivery system which delivers ink to one or more printheads. Each of these printheads generally has several nozzles which function to eject ink during the printing process.

As a popular printing apparatus, ink-jet printers are used in a variety of settings, and are subjected to a range of operating conditions and demands. For example, some ink-jet printers are used frequently, while others are used rarely and thus experience extended idle times. Some ink-jet printers remain stationary in an office or home, while others are transported to various locations where they are used to perform printing functions. Ink-jet printers are subjected to a variety of environmental conditions, which may include, but are not limited to, extreme temperatures, varying degrees of humidity, air-borne pollutants, direct sun-light and frequent movement. As a result of these diverse use patterns and operating conditions, ink-jet printers operate under a variety of environmental conditions. One situation that may result from long idle times or varying environmental conditions is a thickening of the ink within the printhead due to fluid loss (i.e., vaporization or migration of the carrying fluid used to transport the ink pigments), which can cause poor print quality or printhead failure. To accommodate these diverse use patterns and operating conditions, it is desirable to develop printing apparatus which will satisfy such demands.

SUMMARY

Imaging apparatus and methods of homogenizing ink are described. The embodiments disclosed herein are for illustrative purposes and should not be construed as limiting the invention.

In one implementation an imaging apparatus is described. The imaging apparatus includes an ink supply which provides ink to be used in printing, and a printhead which applies the ink during printing. A conduit system couples the ink supply and the printhead in fluid flowing relation. A pump is operably coupled to the conduit system. In operation, the pump causes the ink to circulate between the ink supply and the printhead. A timing device measures an idle-time since the pump was last in operation. A controller receives the idle-time measurement from the timing device, and actuates the pump when a selected idle-time is reached.

In another implementation, a method for homogenizing ink is described. The method includes providing a pump, then automatically actuating the pump to homogenize ink within an ink delivery system each time the ink delivery system has been resting for a selected idle-time.

DETAILED DESCRIPTION

Figure 1:
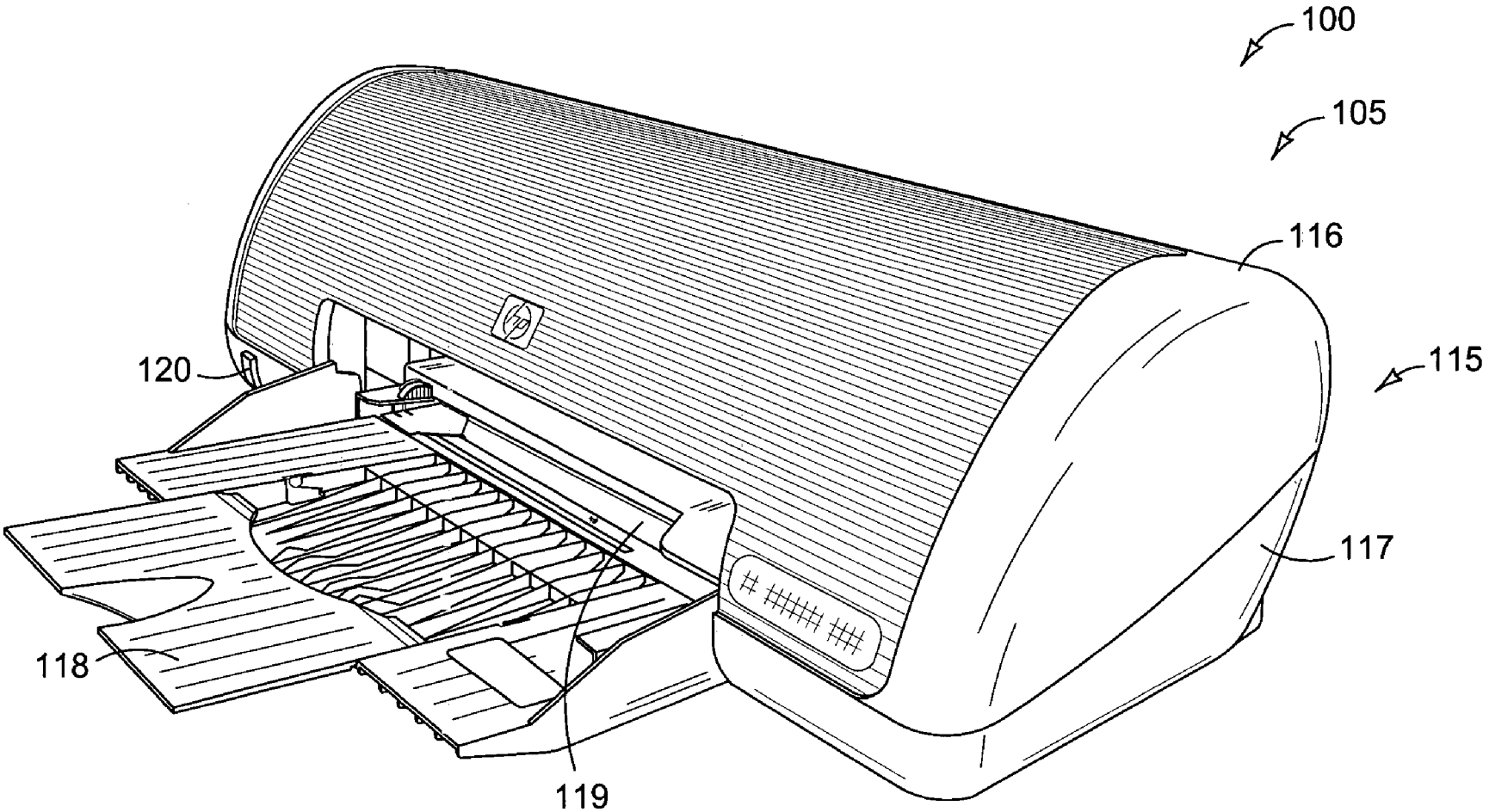
FIG. 1 is a perspective view of an ink-jet printer in accordance with embodiments of the present invention.

Imaging apparatus such as ink-jet printers typically include an ink delivery system which functions to deliver ink from an ink supply or reservoir to one or more printheads. In the context of this document, the term "imaging apparatus" refers to any apparatus which uses ink to generate an image on an imaging media, such as paper or the like. Examples of imaging apparatus include, without by way of limitation, printers, copiers, facsimile machines, and other devices which use ink from a reservoir to apply an image onto imaging media. The term "ink" refers to any liquid medium which can be used for printing, including both water-based and non-water-based inks. Such inks typically comprise dissolved colorants or pigments dispersed in a solvent. In a typical ink-jet printer, printheads are used to apply the ink to an imaging media.

When an ink delivery system in an imaging apparatus, such as an ink-jet printer, remains idle for an extended period of time, print quality can degrade as volatile components such as water, or any other volatile components, are lost from the ink.

Imaging apparatus that do not periodically recirculate or otherwise homogenize the ink can develop regions of ink from which the volatile components have been depleted. In such regions, the ink can become too viscous to be adequately pumped or fully cleared from the system, causing image quality defects or other printing problems or failures. In addition, imaging apparatus that do not periodically homogenize the ink may suffer print quality problems when the concentration of ink in the printhead has moved outside of acceptable limits due to the -loss of volatile components from the ink. In some cases remediation of such problems requires that the printhead be replaced or primed.

In other cases, clogging can occur as volatile components are lost from the ink. Such clogging typically occurs in areas of the ink delivery system which have a small resident ink mass, such as small diameter tubes, or in areas such as the printheads. Because the rate of loss of volatile components from the ink and resident ink mass vary by component, it is advantageous to periodically mix the ink in the system to homogenize the concentration. In the context of this document, the terms "homogenize" and "homogenization" refer to a mixing or circulation (including recirculation) of the ink within the ink delivery system and printhead to decrease potential problems such as image quality defects and clogging.

Imaging apparatus that recirculate ink for a given amount of time before a print job, without recirculating the ink during long idle periods between print jobs, may not adequately homogenize the ink because a clog can occur during the long idle-time. Imaging apparatus which continuously recirculate ink consume large amounts of energy due to the continuous pumping required.

For these and other reasons, it is desirable to develop imaging apparatus, ink delivery systems and methods for homogenizing ink which will help to prevent the degradation of print quality and clogging. Moreover, it is desirable to develop methods and apparatus which will accomplish these objectives in a convenient and efficient manner. It is also desirable that such methods and apparatus be applicable to portable imaging devices. While the present invention is principally directed towards overcoming the above identified issues, the invention is in no way so limited, and is only limited by the accompanying claims as literally worded and appropriately interpreted in accordance with the Doctrine of Equivalents.

Referring to FIG. 1, an imaging apparatus 100 is generally indicated in an isometric view. As depicted, the imaging apparatus 100 is an ink-jet printer 105. The ink-jet printer 105 includes an enclosure or printer housing 115. The printer housing 115 includes an upper housing 116 and a lower housing 117. A loading tray 118 allows paper or other imaging media to be loaded into the feed aperture 119 of the ink-jet printer 105, so that printing activities can be accomplished. A power switch 120 is provided, and functions to connect and disconnect the printer 105 to an external power source. The ink-jet printer 105 is configured to receive print commands from a computer or other similar device which direct the printing operations. It will be appreciated that the ink-jet printer 105 depicts only one example of an imaging apparatus in accordance with the present invention, and that other ink-jet printing apparatus can also be used.

Figure 2:
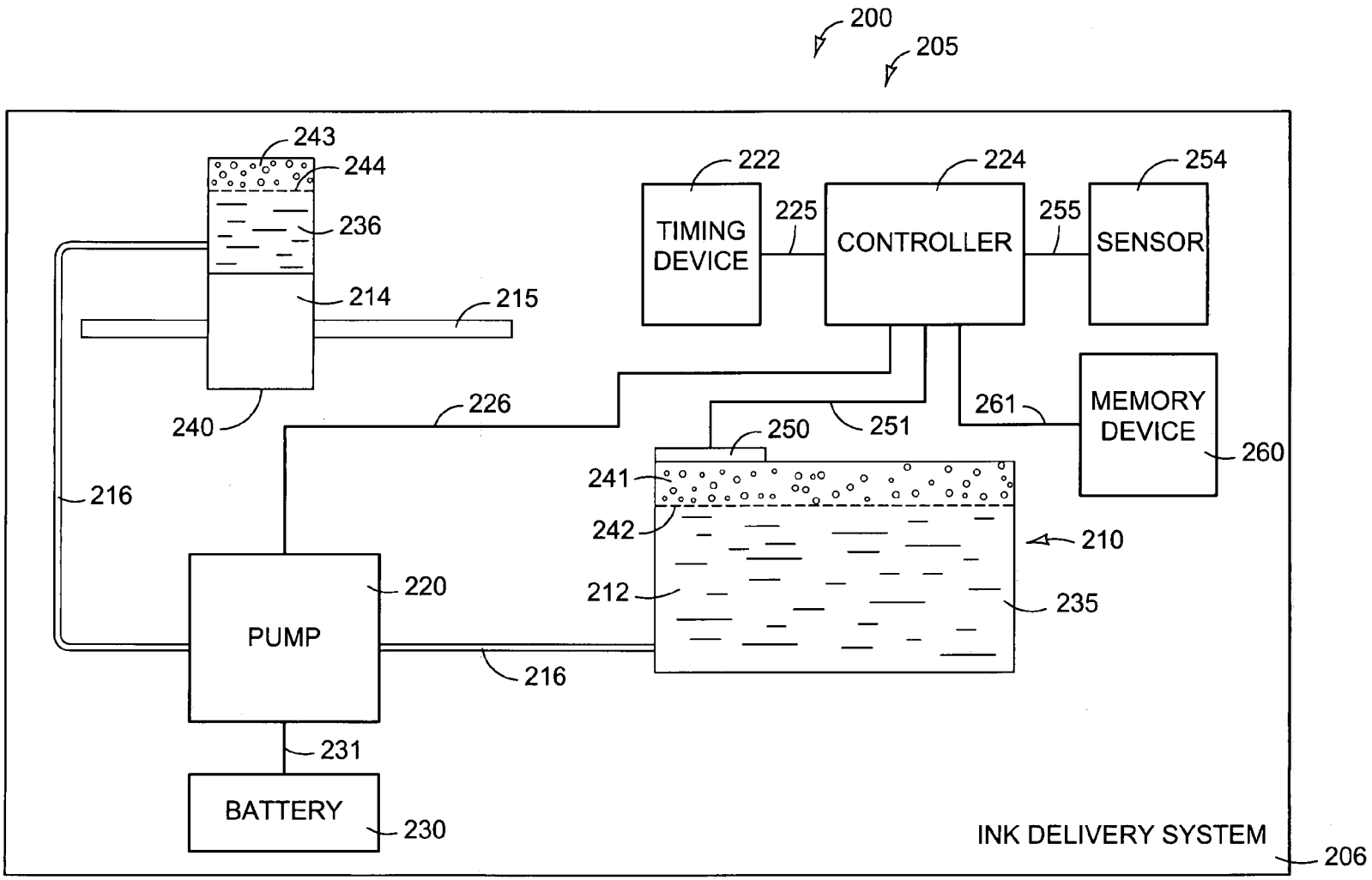
FIG. 2 is a diagrammatic, fragmentary view in accordance with one embodiment of the present invention.

Referring to FIG. 2, an imaging apparatus in accordance with a first embodiment of the present invention is generally indicated in schematic form by the numeral 200. In one embodiment, the imaging apparatus 200 is an ink-jet printer 205. The imaging apparatus 200 includes an ink delivery system 206 which is described in detail below. The imaging apparatus 200 includes an ink supply 210 to provide ink 212 to be used in printing. A printhead 214 is provided to apply the ink 212 onto an imaging media during printing. In the example depicted, the printhead 214 is slideably coupled to a rail 215, so that the printhead 214 can move along the rail 215 during printing activities. A conduit system 216 couples the ink supply 210 and the printhead 214 in fluid flowing relation. A pump 220 is located between the ink supply 210 and the printhead 214, and is operably coupled to the conduit system 216. When in operation, the pump 220 causes the ink 212 to circulate between the ink supply 210 and the printhead 214. A timing device 222 is provided to measure an idle-time since the pump 220 was last in operation. There is also a controller 224 which functions to receive the idle-time measurement from the timing device 222. The controller can be a microprocessor, a state circuit assembly, or other known devices for processing signals and controlling the operation of collateral components in response thereto. Further elaboration of the specific structure of the controller is therefore not necessary for a complete understanding of the present invention. The controller 224 is in signal communication with the timing device 222. In the depicted example, the controller 224 is electrically coupled to the timing device 222 by a timing signal path 225. The controller 224 is also in signal communication with the pump 220. In the depicted example, the controller 224 is electrically coupled to the pump 220 by a pump signal path 226. The controller 224 functions to actuate the pump 220 when a selected idle-time is reached. In the context of this document, the term "idle-time" is defined to mean the duration of time which has elapsed since the pump was last in operation. The term "selected idle-time" is defined to mean the duration of idle-time allowed before which the pump is automatically actuated. The selected idle-time can be varied based on environmental factors and use patterns, as is described more fully below.

If the imaging apparatus 200 is used with a computer (not shown), the computer can function as the controller 224 and the timing device 222. For example, the computer can cause the pump 220 to be actuated when a selected idle-time is reached. In addition, the computer can cause the pump 220 to be actuated to homogenize the ink 212 at any selected time. By way of example only, the computer can actuate the pump 220 at 2:00 a.m. (or any other selected time) when the pumping process is least likely to interrupt business activities.

In one variation, the pump 220 is reversible and in operation intermittently reverses its pumping action to facilitate homogenization of the ink 212. That is, the pump 220 can first pump ink from the printhead 214 to the ink supply 210, and then reverse to pump ink from the ink supply 210 to the printhead 214 (or vis-a-versa). The reversing of the pump can be controlled by the controller 224. The use of any suitable pump is contemplated, for example in one embodiment the pump 220 is a peristaltic pump. Other types of pumps can also be used such as, without by way of limitation, a centrifugal pump or a positive displacement pump. When the pump 220 is a peristaltic pump, then a section of the conduit 216 can be a flexible segment (not shown, but generally within pump 220), and the pump can include a moveable member (also not shown) which can be moved along a portion of the flexible segment to thereby urge ink in the flexible segment to move in the direction of the moveable member.

In another variation, a battery 230 is electrically coupled to the pump 220 by a battery path 231. In operation, the battery 230 powers the pump 220. The battery 230 allows the pump 220 to function without an external power source. In other variations, the pump 220 can be powered by another power source (not shown), such as the power source which is used by the ink-jet printer 205 for normal printing operations. Additionally, the pump 220 can be configured to be driven primarily by the power source which is used by the ink-jet printer 205 for normal printing operations, and, when the printer 205 is disconnected from such a power source, to use the battery 230 as a power source.

Referring again to FIG. 2, the ink supply 210 includes a primary ink supply 235 separate from the printhead 214, and a secondary ink supply 236 proximate the printhead 214. In one variation, the primary ink supply 235 can be replaced without replacing the printhead 214. The printhead 214 includes an ink nozzle 240 through which ink 212 passes during printing. The flow of ink 212 from the primary ink supply 235 to the secondary ink supply 236 facilitates homogenization of ink at the ink nozzle 240. An air/froth mixture 241 is shown over the surface 242 of the ink 212 in the primary ink supply 235. Similarly, an air/froth mixture 243 is shown over the surface 244 of the ink 212 in the secondary ink supply 236.

In another variation, a smart-chip 250 is operably coupled to the ink supply 210. By way of example, and not by way of limitation, the smart-chip can be electronic memory, ROM, EEPROM, or battery backed RAM. The smart-chip 250 is encoded with pump-time parameters. In the context of this document, the term "pump-time parameters" is defined to mean any information regarding the ink, the pump, environmental conditions, and/or operating conditions which can affect the pumping used to homogenize the ink. By way of example only, pump-time parameters can include, but are not limited to, information regarding the type of ink, the age of ink, and the volume of ink. As other examples, the pump-time parameters can include information such as the pump-rate (i.e., the number of pump revolutions per minute), the pump-time (i.e., the duration of time the pump operates to complete a print job), and the selected idle-time (i.e., the duration of idle-time allowed before the pump is automatically triggered to run). The smart-chip 250 is electrically coupled to the controller 224 by smart-chip path 251. The controller 224 receives signals from the smart-chip 250 to facilitate homogenization of the ink. These signals from the smart-chip 250 aid the controller 224 in determining what pumping will adequately homogenize the ink 212. It will be appreciated that the smart-chip 250 and the controller 224 can be combined into a single unit.

Referring still to FIG. 2, in one embodiment, the ink delivery system 206 includes a sensor 254 to measure an environmental condition which can affect homogenization of the ink 212, and a controller 224 to receive the measurement from the sensor 254 and to generate, based at least in part upon the measurement, a control signal to the pump 220 to thereby manage homogenization of the ink 212. The sensor 254 is electrically coupled with the controller 224 by a sensor signal path 255.

In one variation the sensor 254 is configured to measure a humidity level. In another variation the sensor 254 is configured to measure a temperature. The sensor 254 can be configured to measure any environmental condition which can affect homogenization of the ink 212, and the measurement of any and all such environmental conditions is contemplated by the present invention. Further, two or more such sensors 254 can be used in combination to measure two or more such environmental conditions.

In one variation on the present embodiment of the invention, the ink delivery system 206 includes a smart-chip 250 encoded with pump-time parameters. The smart-chip 250 is operably coupled to the ink supply 210, and is electrically coupled to the controller 224 by smart-chip path 251. The controller 224 receives the pump-time information from the smart-chip 250. The controller 224 then generates, based at least in part upon the pump-time information, a control signal to the pump 220 to thereby manage homogenization of the ink 212. In another variation the pump-time information includes data regarding an ink type. In yet another variation the pump-time information includes data regarding an ink volume. In still a further variation the pump-time information includes data regarding an ink age. The smart-chip 250 can include any pump-time data that is useful in managing homogenization of the ink 212, and the inclusion of any and all such pump-time information is contemplated by the present invention.

Figure 3:
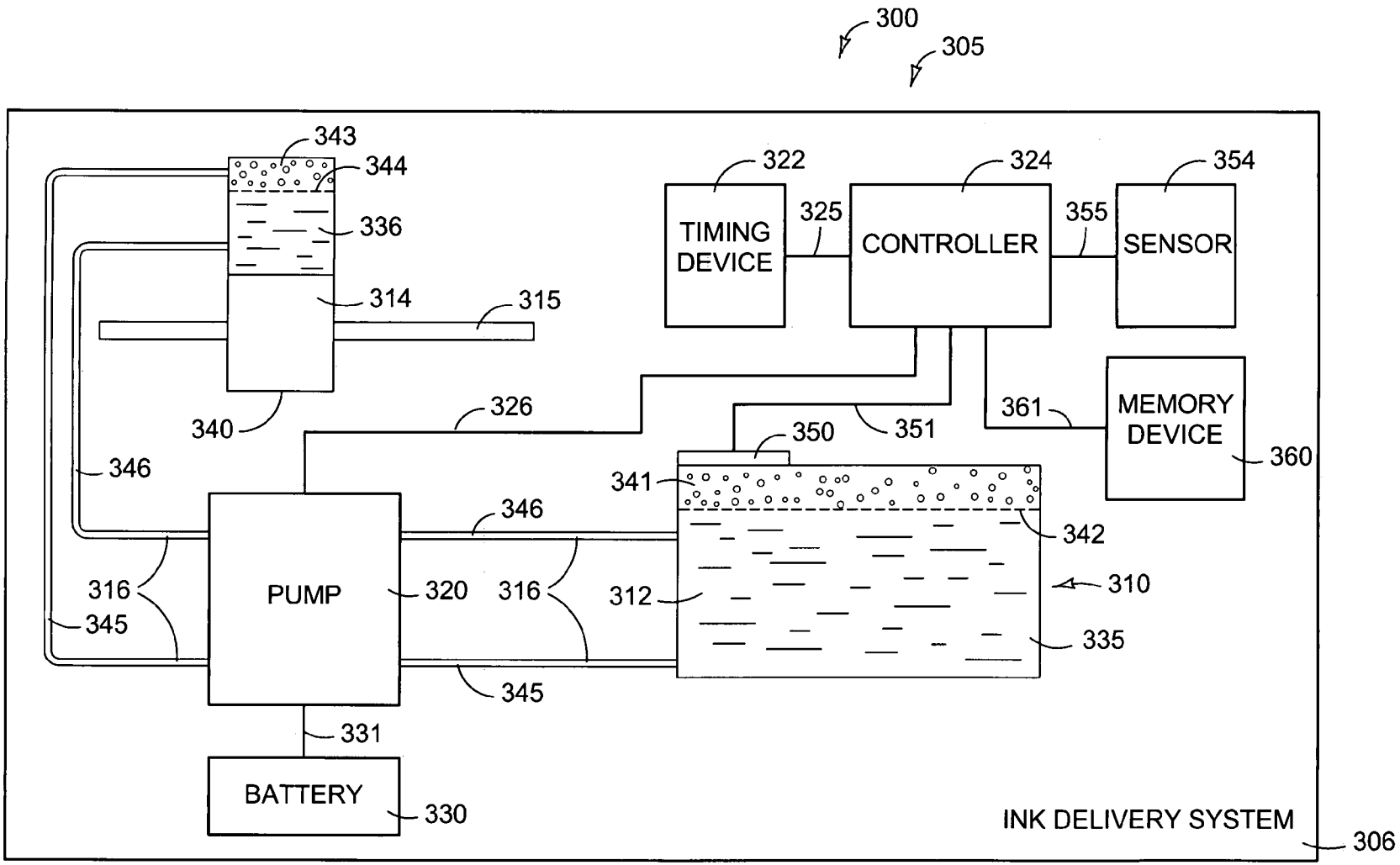
FIG. 3 is a diagrammatic, fragmentary view in accordance with another embodiment of the present invention.

Referring now to FIG. 3, an imaging apparatus is generally indicated by the numeral 300. In one embodiment, the imaging apparatus 300 is an ink jet printer 305. The imaging apparatus 300 includes an ink delivery system 306 which is described in detail below. The imaging apparatus 300 includes an ink supply 310 to provide ink 312 to be used in printing. A printhead 314 is provided to apply the ink 312 during printing. In the example depicted, the printhead 314 is slideably coupled to a rail 315, so that the printhead 314 can move along the rail 315 during printing activities. A conduit system 316 couples the ink supply 310 and the printhead 314 in fluid flowing relation. A pump 320 is located between the ink supply 310 and the printhead 314, and is operably coupled to the conduit system 316. When in operation, the pump 320 causes the ink 312 to circulate between the ink supply 310 and the printhead 314. A timing device 322 is provided to measure an idle-time since the pump 320 was last in operation. There is also a controller 324 which functions to receive the idle-time measurement from the timing device 322. The controller 324 is electrically coupled to the timing device 322 by a timing signal path 325. The controller 324 is also electrically coupled to the pump 320 by the pump signal path 326. The controller 324 functions to actuate the pump 320 when a selected idle-time is reached.

The use of any suitable pump 320 is contemplated, for example in one variation the pump 320 is a peristaltic pump. As described above with respect to pump 220 of FIG. 2, other types of pump can also be used. As depicted, a battery 330 is electrically coupled to the pump 320 by a battery path 331. In operation, the battery 330 powers the pump 320. The battery 330 allows the pump 320 to function without an external power source. As indicated above with respect to the battery 230 of FIG. 2, the battery 330 of FIG. 3 can be replaced with, or supplemented with, a power source (not shown) that is normally used to power the ink jet printer 305.

Referring again to FIG. 3, the ink supply 310 includes a primary ink supply 335 separate from the printhead 314, and a secondary ink supply 336 proximate the printhead 314. In one variation, the primary ink supply 335 can be replaced without replacing the printhead 314. The printhead 314 includes an ink nozzle 340 through which ink 312 passes during printing. The flow of ink 312 from the primary ink supply 335 to the secondary ink supply 336 facilitates homogenization of ink at the ink nozzle 340. An air/froth mixture 341 is shown over the surface 342 of the ink 312 in the primary ink supply 335. Similarly, an air/froth mixture 343 is shown over the surface 344 of the ink 312 in the secondary ink supply 336.

The conduit system 316 includes a supply conduit 345 which couples the primary ink supply 335 and the secondary ink supply 336 in fluid flowing relation. In operation the supply conduit 345 facilitates a flow of ink 312 from the primary ink supply 335 to the secondary ink supply 336. The conduit system 316 also includes a return conduit 346 which couples the secondary ink supply 336 and the primary ink supply 335 in fluid flowing relation. In operation the return conduit 346 facilitates a flow of ink from the secondary ink supply 336 to the primary ink supply 335. As the ink 312 circulates or recirculates through the conduit system 316, the ink is homogenized. When the pump 320 is a peristaltic pump, then a section (not shown, but generally within pump 320) of the supply conduit 345, and a section (also not shown, but generally within pump 320) of the return conduit 346 can be flexible segments. In this case the pump 320 can include first and second moveable members (not shown). The first moveable member can be moved along the flexible segment of the supply conduit 345 to thereby urge ink in the supply conduit to move in the direction of the first moveable member. Likewise, the second moveable member can be moved along the flexible segment of the return conduit 346 to thereby urge ink in the return conduit to move in the direction of the second moveable member. The first and second moveable members can be attached to a common rotating shaft such that simultaneous pumping of ink in the supply and return conduits 345, 346 occurs.

In one variation, a smart-chip 350 is operably coupled to the ink supply 310. The smart-chip 350 is encoded with pump-time parameters. The smart-chip 350 is electrically coupled to the controller 324 by smart-chip path 351. The controller 324 receives signals from the smart-chip 350 to facilitate homogenization of the ink. As indicated above with respect to smart-chip 250, the smart-chip 350 can be, for example, electronic memory, ROM, EEPROM, battery backed RAM, or other computer readable memory.

Referring now to FIGS. 2 and 3, an imaging apparatus 200, 300 is described. The imaging apparatus 200, 300 includes an ink supply means 210, 310 for providing ink 212, 312 to be used in printing, and a printhead means 214, 314 for applying the ink 212, 312 during printing. An ink conduit means 216, 316 is provided for coupling the ink supply means 212, 312 and the printhead means 214, 314 in fluid flowing relation. A pump means 220, 320 is operably coupled to the ink conduit means 216, 316 for circulating the ink 212, 312 between the ink supply means 210, 310 and the printhead means 214, 314. The imaging apparatus 200, 300 also includes a timing device means 222, 322 for measuring an idle-time since the pump means 220, 320 was last in operation. A controller means 224, 324 is provided for receiving the idle-time measurement from the timing device means 222, 322 and actuating the pump means 220, 320 when a selected idle-time is reached.

Referring once again to FIG. 3, in another embodiment the controller 324 is configured to receive idle-time measurements from the timing device 322, and pump-time information from the smart-chip 350. Then the controller 324, based at least in part upon the idle-time measurements and pump-time information, intermittently actuates the pump 320 for a duration adequate to homogenize the ink 312.

In one variation, the ink-jet printer 305 also includes a sensor 354 to measure an environmental condition which affects homogenization of the ink 312. The sensor 354 is electrically coupled to the controller by sensor signal path 355. The controller 324 is configured to receive the environmental measurement from the sensor 354, and based at least in part upon the environmental measurement, the controller 324 intermittently actuates the pump 320 for a duration adequate to homogenize the ink 312. In another variation, the ink-jet printer 305 includes a battery 330 electrically coupled to the pump 320. In operation the battery 330 powers the pump 320, and in operation the battery 330 also powers the ink-jet printer 305. The battery 330 allows both the pump 320 and the ink-jet printer 305 to function without an external power source.

Referring again to FIG. 3, in one embodiment the ink-jet printer 305 includes an ink supply 310 to provide ink 312 to be used in printing, a printhead 314 to apply the ink 312 during printing, and a conduit system 316 which couples the ink supply 310 and the printhead 314 in fluid flowing relation. A pump 320 is operably coupled to the conduit system 316. In operation the pump 320 causes the ink 312 to circulate between the ink supply 310 and the printhead 314 thereby homogenizing the ink 312. The pump 320 automatically functions to intermittently homogenize the ink 312 independently of printing activities.

Referring again to FIGS. 2 and 3, another embodiment of the invention is described. This embodiment includes a computer readable medium or computer memory device 260, 360 of respective FIGS. 2 and 3. This computer readable medium 260, 360 is in signal communication with the controller 224, 324. In the examples depicted, a memory signal path 261, 361 electrically couples the controller 224, 324 to the computer memory 260, 360. The computer readable medium 260, 360 includes a set of computer executable instructions configured to cause the controller 224, 324 to intermittently actuate the pump 220, 320 for a duration adequate to homogenize the ink 212, 312 within the ink delivery system 206, 306 and independently of printing activities.

A further embodiment of the invention provides for a method of homogenizing ink in an ink delivery system, such as ink delivery systems 206 and 306 of respective FIGS. 2 and 3. The method includes providing a pump (e.g., pump 220 or 320 of FIGS. 2 and 3, respectively), and then automatically actuating the pump 220, 320 to homogenize ink 212, 312 within the ink delivery system each time the ink delivery system has been resting for a selected idle-time.

Yet another embodiment of the present invention provides a method for homogenizing ink which includes the step of providing an ink supply (such as ink supplies 210, 310 of respective FIGS. 2 and 3). The ink supply 210, 310 functions to provide ink 212, 312 to be used in printing. The method also includes providing a printhead (e.g., printhead 214 or 314 of respective FIGS. 2 and 3) which is used to apply the ink 212, 312 during printing operations, and then coupling the ink supply 210, 310 and the printhead 214, 314 in fluid flowing relation. The method further includes measuring an idle-time, and then circulating the ink 212, 312 between the ink supply 210, 310 and the printhead 214, 314 when a selected idle-time is reached to thereby homogenize the ink. In one variation the method also includes measuring a print-time used to complete a printing job, and then circulating the ink 212, 312 between the ink supply 210, 310 and the printhead 214, 314 based at least in part on the print-time measurement. In another variation the method includes sensing a humidity level, and then circulating the ink 212, 312 between the ink supply 210, 310 and the printhead 214, 314 based at least in part on the humidity level measurement. In yet another variation the method includes providing a sensor (e.g., sensor 254 or 354 of respective FIGS. 2 and 3) to measure a temperature, and then circulating the ink 212, 312 between the ink supply 210, 310 and the printhead 214, 314 based at least in part on the temperature measurement.

It will be appreciated that the ink supplies 210, 310 (FIGS. 2 and 3, respectively) can be disposable, replaceable, ink cartridges. As such, the smart chips 250, 350 can be provided with the respective ink cartridges 210, 310. In this way, when a first disposable ink supply 210, 310 is replaced with a new or fresh ink supply 210, 310, the smart chip 250, 350 on the new ink supply can be provided with information useful for determining circulation of ink within the ink supply 210, 310, in accordance with the embodiments and variations thereof described above. Accordingly, a further embodiment of the present invention provides for an ink cartridge 210, 310 comprising a smart-chip 250, 350 which includes the information and functionality described above.

Figure 4:
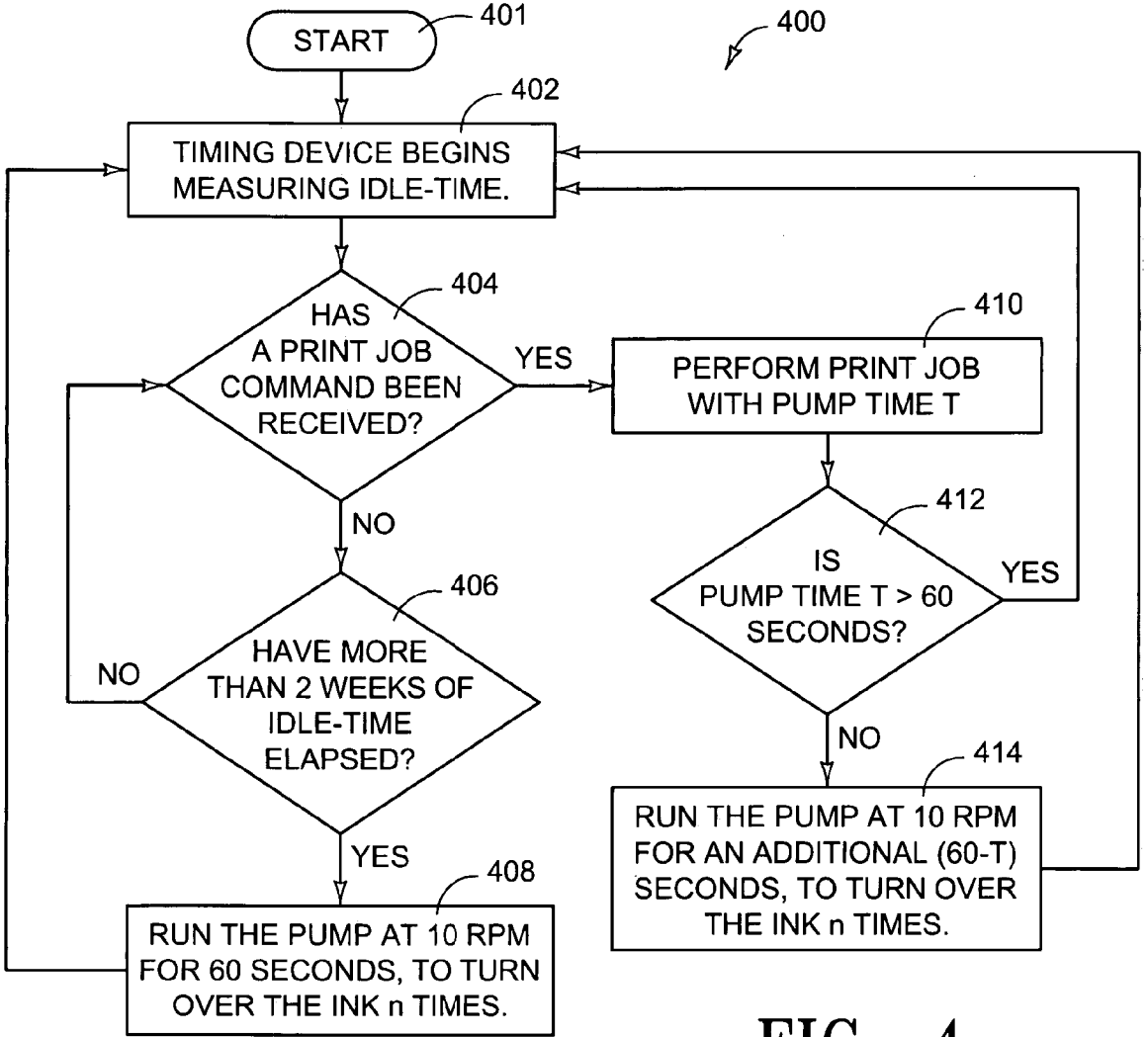
FIG. 4 is a flow-chart representing one aspect of operation in accordance with a further embodiment of the present invention.

Now referring to FIG. 4, an exemplary flowchart 400 is described with respect to an ink delivery system in accordance with an embodiment of the present invention. The numbers used in FIG. 4 to describe the flowchart 400 are by way of example only, and not by way of limitation. In practice, the pump-rate (number of pump revolutions per minute), pump-time (i.e., duration of time the pump operates), and selected idle-time (i.e., the duration of idle-time allowed before the pump is automatically triggered to run) can vary for each particular ink delivery system. Pump-rate, pump-time, and selected idle-time can also be varied based on environmental conditions such as temperature and humidity, if such information regarding environmental conditions is made available to the controller. In the example described below, the pump-rate is ten revolutions per minute (10 rpm), the pump-time is sixty seconds (60 s), and the selected idle-time is two weeks (2 weeks). Once again, these numbers are by way of example only. Flowchart 400 will be described with respect to FIG. 2 for purposes of illustration, although the flowchart can be used for ink delivery systems other than that depicted in FIG. 2.

As depicted in FIG. 4, the flowchart 400 starts at numeral 401. Next, the timing device (e.g., 222, FIG. 2) begins to measure an idle-time at step 402 (FIG. 4). The idle-time is the amount of time which has elapsed since the pump (e.g., pump 220, FIG. 3) was last in operation.

At step 404 (FIG. 4) the controller (e.g., 224, FIG. 2) continually checks if a print job command has been received. If no print job command has been received at step 404, then at step 406 (FIG. 4) the controller checks to determine if two weeks of idle-time have elapsed since the ink (e.g., 212, FIG. 2) was last circulated. (In this example the selected idle-time is two weeks.) If two weeks of idle-time have elapsed, then at step 408 (FIG. 4) the controller causes the pump (e.g., 220, FIG. 2) to run at ten revolutions per minute (10 rpm) for sixty seconds (60 s). This causes the ink within the ink delivery system (e.g., 206, FIG. 2) to turn over (i.e., recirculate) "n" times. After the ink has been recirculated "n" times, then at step 402 (FIG. 4) the timing device once again begins to measure the idle-time. If at step 406 (FIG. 4) it is determined that less than two weeks of idle-time have elapsed, then the controller returns to step 404 to check if a print command has been received.

If at step 404 (FIG. 4) a print job command has been received, then at step 410 the print job is performed. Pump-time "T" is the time required to complete the print job. At step 412 (FIG. 4) the controller then checks to determine whether or not the print job required the pump to run for more than sixty seconds. If the pump-time is more than sixty seconds, then the ink within the ink delivery system is assumed to have been adequately recirculated or homogenized, and the timing device once again begins to measure the idle-time at step 402 (FIG. 4). If at step 412 (FIG. 4) it is determined that the pump-time is less than sixty seconds, then it is assumed that the ink within the ink delivery system has not been adequately recirculated or homogenized, and that the pump should be run for an additional period of time to adequately recirclulate the ink. Accordingly, at step 414 (FIG. 4) the controller will cause the pump to run at ten revolutions per minute (10 rpm) for an additional (60-T) seconds, to turn over the ink "n" times.

One or more of the pump-time parameters can be stored in the smart chip 250, 350 which is operably coupled to the ink supply 210, 310 (shown in respective FIGS. 2 and 3). By way of example only, the pump-time parameters can include, but are not limited to, information regarding the type of ink, the age of ink, the volume of ink, the pump-rate, the pump-time, and the selected idle-time. As shown in FIGS. 2 and 3, the smart-chip 250, 350 can be stored on the ink supply 210, 310.

Other methods consistent with the present invention can also be performed. While the exemplary methods described above with respect to flowchart 400 recite respective steps and orders of execution, it is to be understood that other suitable methods including other steps and/or orders of execution can also be used. While the above methods and apparatus have been described in language more or less specific as to structural and methodical features, it is to be understood, however, that they are not limited to the specific features shown and described, since the means herein disclosed comprise preferred forms of putting the invention into effect. The methods and apparatus are, therefore, claimed in any of their forms or modifications within the proper scope of the appended claims appropriately interpreted in accordance with the Doctrine of Equivalents.

We claim:

1. An imaging apparatus, comprising:

an ink supply to provide ink to be used in printing:

a printhead to apply the ink during printing;

a conduit system coupling the ink supply and the printhead in fluid flowing relation;

a pump operably coupled to the conduit system, and which in operation causes the ink to circulate between the ink supply and the printhead;

a timing device to measure an idle-time since the pump was last in operation; and a controller to receive the idle-time measurement from the timing device, and which actuates the pump when a selected idle-time is reached.

2. The imaging apparatus of claim 1, wherein the pump is reversible and in operation intermittently reverses its pumping action to facilitate homogenization of the ink.

3. The imaging apparatus of claim 1, wherein the pump is a peristaltic pump.

4. The imaging apparatus of claim 1, further comprising a battery electrically coupled to the pump, and which in operation powers the pump.

5. The imaging apparatus of claim 1, wherein the ink supply comprises:1 a primary ink supply separate from the printhead; and a secondary ink supply proximate to the printhead.

6. The imaging apparatus of claim 5, wherein the primary ink supply can be replaced without replacing the printhead.

7. The imaging apparatus of claim 5, wherein the conduit system comprises:

a supply conduit which couples the primary ink supply and the secondary ink supply in fluid flowing relation, and which in operation facilitates a flow of ink from the primary ink supply to the secondary ink supply; and a return conduit which couples the secondary ink supply and the primary ink supply in fluid flowing relation, and which in operation facilitates a flow of ink from the secondary ink supply to the primary ink supply.

8. The imaging apparatus of claim 7, wherein the printhead comprises:

an ink nozzle through which the ink passes during printing, and wherein the flow of ink from the primary ink supply to the secondary ink supply facilitates homogenization of the ink at the ink nozzle.

9. The imaging apparatus of claim 1, further comprising:

a smart-chip operably coupled to the ink supply, wherein the smart-chip is encoded with pump-time parameters, and wherein the controller recieves signals from the smart-chip to facilitate homogenization of the ink.

10. An ink delivery system, comprising:

an ink supply to provide ink to be used in printing;

a printhead to apply the ink during printing;

a conduit system coupling the ink supply and the printhead in fluid flowing relation;

a pump operably coupled to the conduit system, and which in operation causes the ink to circulate between the ink supply and the printhead;

a sensor to measure an environmental condition which affects homogenization of the ink; and a controller to receive the measurement from the sensor and to generate, based at least in part upon the measurement, a control signal to the pump to thereby manage homogenization of the ink.

11. The ink delivery system of claim 10, wherein the wherein the pump is reversible and in operation intermittently reverses its pumping action to facilitate homogenization of the ink.

12. The ink delivery system of claim 10, wherein the pump is a peristaltic pump.

13. The ink delivery system of claim 10, further comprising a battery electrically coupled to the pump, and which in operation powers the pump.

14. The ink delivery system of claim 10, wherein the sensor is configured to measure a humidity level.

15. The ink delivery system of claim 10, wherein the sensor is configured to measure a temperature.

16. The ink delivery system of claim 10, further comprising:

a smart-chip encoded with pump-time information, and which is operably coupled to the ink supply, and which is electrically coupled to the controller, and wherein the controller receives the pump-time information from the smart-chip, and wherein the controller generates, based at least in part upon the pump-time information, a control signal to the pump to thereby manage homogenization of the ink.

17. The ink delivery system of claim 16, wherein the pump-time information includes data regarding an ink type.

18. The ink delivery system of claim 16, wherein the pump-time information includes data regarding an ink volume.

19. The ink delivery system of claim 16, wherein the pump-time information includes data regarding an ink age.

20. The ink delivery system of claim 16, wherein the pump-time information includes data regarding a pump-rate.

21. The ink delivery system of claim 16, wherein the pump-time information includes data regarding a pump-time.

22. The ink delivery system of claim 16, wherein the pump-time information includes data regarding a selected idle-time.

23. An imaging apparatus, comprising:

an ink supply means for providing ink to be used in printing;

a printhead means for applying the ink during printing;

an ink conduit means for coupling the ink supply means and the printhead means in fluid flowing relation;

a pump means operably coupled to the ink conduit means for circulating the ink between the ink supply means and the printhead means;

a timing device means for measuring an idle-time since the pump means was last in operation; and a controller means for receiving the idle-time measurement from the timing device means and actuating the pump means when a selected idle-time is reached.

24. An ink-jet printer, comprising:

an ink supply to provide ink to be used in printing;

a printhead to apply the ink during printing;

a conduit system coupling the ink supply and the printhead in fluid flowing relation a pump operably coupled to the conduit system, and which in operation causes the ink to circulate between the ink supply and the printhead thereby homogenizing the ink;

a timing device to measure an idle-time since the pump was last in operation; a smart-chip encoded with pump-time information, and which is operably coupled to the ink supply;

a controller configured to receive the idle-time measurement from the timing device, and configured to receive the pump-time information from the smart-chip, and wherein based at least in part upon the idle-time measurement, and wherein based at least in part upon the pump-time information, the controller intermittently actuates the pump for a duration adequate to homogenize the ink.

25. The ink-jet printer of claim 24, further comprising:

a sensor to measure an environmental condition which affects homogenization of the ink, and wherein the controller is configured to receive the environmental measurement from the sensor, and wherein based at least in part upon the environmental measurement, the controller intermittently actuates the pump for a duration adequate to homogenize the ink.

26. The ink-jet printer of claim 24, and further comprising:

a battery electrically coupled to the pump, which in operation powers the pump, and which in operation powers the ink-jet printer.

27. An ink cartridge, comprising:

an ink supply to provide ink to be used in printing;

a printhead to apply the ink during printing;

a conduit system coupling the ink supply and the printhead in fluid flowing relation;

wherein the ink cartridge is configured to be used in an ink printer which includes:

a pump operably coupled to the conduit system, and which in operation causes the ink to circulate between the ink supply and the printhead;

a sensor to measure an environmental condition which affects homogenization of the ink; and a controller to receive the measurement from the sensor and to generate, based at least in part upon the measurement, a control signal to the pump to thereby manage homogenization of the ink;

the ink cartridge further comprising a smart-chip encoded with pump-time information, and which is operably coupled to the ink supply, and which is electrically couplable to the controller, and wherein, when the ink cartridge is placed in the ink printer, the controller can receive the pump-time information from the smart-chip, and the controller can generate, based at least in part upon the pump-time information, a control signal to the pump to thereby manage homogenization of the ink.

28. The ink cartridge of claim 27, and wherein the pump-time information includes data regarding a pump-rate.

29. The ink cartridge of claim 27, and wherein the pump-time information includes data regarding a pump-time.

30. The ink cartridge of claim 27, and wherein the pump-time information includes data regarding a selected idle-time.

* * * * *

UNITED STATES PATENT AND TRADEMARK OFFICE

CERTIFICATE OF CORRECTION

PATENT NO. : 7,140,724 B2
APPLICATION NO. : 10/845755
DATED : November 28, 2006
INVENTOR(S) : David R. Otis et al.

It is certified that error appears in the above-identified patent and that said Letters Patent is hereby corrected as shown below:

In column 10, line 27, in Claim 5, after “comprises:” delete “l”.

In column 10, line 52, in Claim 9, delete “recieves” and insert -- receives --, therefor.

In column 11, line 2, in Claim 11, delete “wherein the” before “pump”.

Signed and Sealed this

Ninth Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 7,140,724 B2
APPLICATION NO. : 10/845755
DATED : November 28, 2006
INVENTOR(S) : David R. Otis et al.

It is certified that error appears in the above-identified patent and that said Letters Patent is hereby corrected as shown below:

In column 10, line 27, in Claim 5, after “comprises:” delete “1”.

In column 10, line 52, in Claim 9, delete “recieves” and insert -- receives --, therefor.

In column 11, line 2, in Claim 11, delete “wherein the” before “pump”.

Signed and Sealed this

Twenty-third Day of December, 2008

JON W. DUDAS
*Director of the United States Patent and Trademark Office*

UNITED STATES PATENT AND TRADEMARK OFFICE

CERTIFICATE OF CORRECTION

PATENT NO. : 7,140,724 B2
APPLICATION NO. : 10/845755
DATED : November 28, 2006
INVENTOR(S) : David R. Otis et al.

It is certified that error appears in the above-identified patent and that said Letters Patent is hereby corrected as shown below:

This certificate vacates the Certificate of Correction issued December 23, 2008. The certificate is a duplicate of the Certificate of Correction issued December 9, 2008. All requested changes were included in the Certificate of Correction issued December 9, 2008.

Signed and Sealed this

Third Day of February, 2009

John Doll

JOHN DOLL
*Acting Director of the United States Patent and Trademark Office*